US007051903B2

(12) United States Patent
Lewis et al.

(10) Patent No.: US 7,051,903 B2
(45) Date of Patent: May 30, 2006

(54) VISCOUS LIQUID DISPENSER HAVING LEAK PREVENTION DEVICE

(75) Inventors: Richard Paul Lewis, Marietta, GA (US); Randall Marc Bachtel, Duluth, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 198 days.

(21) Appl. No.: 10/675,034

(22) Filed: Sep. 30, 2003

(65) Prior Publication Data

US 2005/0067437 A1 Mar. 31, 2005

(51) Int. Cl.
*B67B 1/08* (2006.01)

(52) U.S. Cl. ..... 222/153.14; 222/321.2; 222/321.9; 222/341

(58) Field of Classification Search ..... 222/153.04, 222/153.13, 153.14, 321.9, 383.3, 321.1, 222/321.2, 321.7, 341, 384, 402.11
See application file for complete search history.

(56) References Cited

U.S. PATENT DOCUMENTS

| | | | | |
|---|---|---|---|---|
| 2,804,240 | A | 8/1957 | Anderson | |
| 2,956,509 | A * | 10/1960 | Cooprider et al. | 417/561 |
| 3,321,111 | A * | 5/1967 | Jellinek | 222/153.13 |
| 4,174,056 | A | 11/1979 | Loeffler | |
| 4,286,736 | A * | 9/1981 | Corsette | 222/153.13 |
| 4,340,158 | A * | 7/1982 | Ford et al. | 222/153.13 |
| 4,375,266 | A * | 3/1983 | Magers | 222/153.13 |
| 4,410,107 | A | 10/1983 | Corsette | |
| 4,441,633 | A | 4/1984 | Bennett | |
| 4,479,589 | A * | 10/1984 | Ford | 222/153.13 |
| 4,512,501 | A * | 4/1985 | Foster | 222/153.13 |
| 4,524,888 | A * | 6/1985 | Tada | 222/153.02 |
| 5,184,760 | A | 2/1993 | Weinstein et al. | |
| 5,379,919 | A | 1/1995 | Gueret | |
| 5,615,806 | A * | 4/1997 | Grothoff | 222/153.13 |
| 5,720,419 | A * | 2/1998 | Li | 222/321.2 |
| 5,810,203 | A | 9/1998 | Brennan | |
| 5,860,574 | A | 1/1999 | Shanklin et al. | |
| 5,975,372 | A | 11/1999 | Heyn | |
| 6,206,245 | B1 * | 3/2001 | Bonningue | 222/321.7 |
| 6,516,976 | B1 | 2/2003 | Lewis et al. | |

(Continued)

FOREIGN PATENT DOCUMENTS

| | | |
|---|---|---|
| GB | 2034799 | 6/1980 |

(Continued)

OTHER PUBLICATIONS

Patent Abstracts of Japan, JP 10028907, Feb. 3, 1998, Mitani Valve:KK.

(Continued)

*Primary Examiner*—Michael Mar
*Assistant Examiner*—Melvin A. Cartagena
(74) *Attorney, Agent, or Firm*—Richard M. Shane; Nathan P. Hendon

(57) ABSTRACT

A dispenser for dispensing metered amounts of a viscous liquid includes a liquid reservoir and a pump chamber having an opening in communication with the reservoir. A pump mechanism including a pump cylinder with a dispensing channel therethrough is configured with the pump chamber and is movable from a rest to a pressurizing position upon actuation thereof to pressurize liquid within the pump chamber. A dispensing orifice is defined at one end of the dispensing cylinder. A check valve mechanism is disposed in the opening. During shipment or storage, the pump cylinder is locked in pressurized position. When locked in pressurized position, the dispensing channel engages the check valve to seal the opening and also prevent flow from the pump chamber to the dispensing channel.

4 Claims, 5 Drawing Sheets

U.S. PATENT DOCUMENTS

| | | | | |
|---|---|---|---|---|
| 6,533,145 | B1 | 3/2003 | Lewis et al. | |
| 6,543,651 | B1 | 4/2003 | Lewis et al. | |
| 6,575,334 | B1 | 6/2003 | Lewis et al. | |
| 6,575,335 | B1 | 6/2003 | Lewis et al. | |
| 6,726,064 | B1 * | 4/2004 | Bonningue | 222/321.9 |
| 2002/0047571 | A1 | 4/2002 | Yoshioka et al. | |
| 2002/0074354 | A1 | 6/2002 | Lewis et al. | |
| 2002/0074355 | A1 | 6/2002 | Lewis et al. | |
| 2002/0100772 | A1 | 8/2002 | Bonningue | |

FOREIGN PATENT DOCUMENTS

| | | | |
|---|---|---|---|
| WO | WO 02/49490 | A1 | 6/2002 |

OTHER PUBLICATIONS

Patent Abstracts of Japan, JP 1258757, Oct. 16, 1989.

* cited by examiner

VISCOUS LIQUID DISPENSER HAVING LEAK PREVENTION DEVICE

BACKGROUND OF THE INVENTION

Viscous liquid dispensers are well known in the art for dispensing any manner of viscous liquid, for example lotions, soap, and the like. The conventional dispensers utilize a wide variety of pumping mechanisms which allow a user to depress or manipulate a pump actuator in order to dispense liquid from the dispenser. Exemplary devices are shown, for example, in U.S. Pat. Nos. 5,810,203; 5,379,919; 5,184,760; and 4,174,056.

Conventional dispensers and pump mechanisms are often configured with locking mechanisms to reduce leakage during shipment or storage. However, locking mechanisms often fail to fully stop leakage, especially in those pumps having a pump mechanism at or below the level of the liquid in the dispenser.

Pump mechanisms with check valves are also known. However, check valves are often designed to work in conjunction with pressure developed through activation of the pump. When the pump is in locked position, there is no pressure being developed to activate the check valve. Also, check valves may improperly seat and allow small leaks that would be insignificant during dispensing, but become significant during extended periods of shipment or storage.

Therefore, there remains a need in the art for a dispenser and dosing pump mechanism having improved capability to prevent leakage during shipment or storage thereof.

SUMMARY OF THE INVENTION

Advantages of the invention will be set forth in part in the following description, or may be obvious from the description, or may be learned through practice of the invention.

The present invention provides a unique dosing pump having a leak protection device that is particularly well suited for viscous liquid dispensers, for example, soap dispensers, lotion dispensers, and the like. The pump may be oriented in a generally horizontal configuration and thus allows great flexibility as to the design and configuration of a dispenser utilizing the pump. The leak protection device is particularly suited to prevent leaks during shipment or storage of the dispenser.

In one embodiment, a dispenser for dispensing metered amounts of a viscous liquid includes a liquid reservoir, a pump chamber having a reservoir opening in communication with the reservoir, a pump mechanism configured with the pump chamber, and a check valve mechanism operably disposed and retained in the reservoir opening.

The pump mechanism includes a pump cylinder slidably disposed and retained in the pump chamber. The pump cylinder has a dispensing channel disposed therethrough. Additionally, the pump cylinder is movable to a locking position within the pump chamber. Upon movement of the pump cylinder to the locking position, the pump cylinder engages the check valve mechanism, seals the check valve mechanism against the reservoir opening to prevent flow from the reservoir to the pump chamber, and seals the dispensing channel against the check valve mechanism to prevent flow from the pump chamber to the dispensing channel. In a further aspect, the dispenser may include an actuator operably connected with the pump mechanism. In an even further aspect, the dispenser may include a biasing element disposed to bias the pump cylinder to a rest position after each dispense.

In one aspect, the pump cylinder includes a radial extension member axially aligned with and extending the length of the dispensing channel. Upon movement of the pump cylinder to the locking position the radial extension member engages the check valve mechanism, seals the check valve mechanism against the reservoir opening to prevent flow from the reservoir to the pump chamber, and seals the dispensing channel against the check valve mechanism to prevent flow from the pump chamber to the dispensing channel.

In another aspect, the check valve mechanism comprises an elongated shuttle valve slidable within the reservoir opening in the pump chamber. The elongated shuttle valve is desirably axially aligned with the dispensing channel and the radial extension member. Optionally, the radial extension member is capable of releasably attaching to the elongated shuttle valve to prevent leaks even when the locking mechanism permits slight movement of the pump cylinder. Releasable attachment of the radial extension member to the check valve mechanism may be facilitated by tapering the radial extension member to permit the radial extension member to fit over and seal against the check valve mechanism. When the radial extension member is capable of releasably attaching to the elongated shuttle valve, the shuttle valve desirably includes at least one retaining member capable of preventing the shuttle valve from being removed from the reservoir opening when the pump cylinder is unlocked. When the pump cylinder is unlocked, the biasing element will cause the radial extension member to separate from the shuttle valve that is restrained by the retaining member.

In a further aspect, the elongated shuttle valve may include a cap having a radial beveled surface to facilitate sealing engagement of the cap with the radial extension member.

In another embodiment, the present invention provides a dosing pump apparatus for dispensing metered amounts of a viscous liquid from a reservoir. The pump apparatus includes a pump chamber having an opening therein in liquid communication with a liquid reservoir, a dispensing orifice defined in the pump chamber, a pump mechanism configured with the pump chamber to pressurize liquid within the pump chamber upon actuation of the pump mechanism, and a check valve mechanism operably disposed and retained in the pump chamber opening and movable upon actuation of the pump mechanism to seal the opening and movable upon release of the pump mechanism to unseal the opening so that a metered amount of liquid flows automatically through the opening into the pump chamber. The pump mechanism is movable to a locking position. Upon movement of the pump mechanism to the locking position the pump mechanism engages the check valve mechanism, seals the check valve mechanism against the reservoir opening to prevent flow from the reservoir to the pump chamber and seals the dispensing orifice to prevent flow from the pump chamber to the dispensing orifice.

In one aspect, the pump mechanism includes a pump cylinder slidably disposed and retained in the pump chamber and biased to a rest position. The pump cylinder further includes a delivery end extending through a front wall of the pump chamber and has a dispensing channel disposed therethrough. The dispensing orifice is disposed at a forward end of the dispensing channel.

In another aspect, the pump cylinder includes a radial extension member axially aligned with and extending the length of the dispensing channel. Upon movement of the pump cylinder to the locking position the radial extension member engages the check valve mechanism, seals the check valve mechanism against the reservoir opening to prevent flow from the reservoir to the pump chamber, and seals the dispensing channel against the check valve mechanism to prevent flow from the pump chamber to the dispensing channel.

In a further aspect, the check valve mechanism includes an elongated shuttle valve slidable within the opening in the pump chamber. Desirably, the elongated shuttle valve is axially aligned with the radial extension member. Optionally, the radial extension member is capable of releasably attaching to the elongated shuttle valve. Releasable attachment of the radial extension member to the check valve mechanism may be facilitated by tapering the radial extension member to permit the radial extension member to fit over and seal against the check valve mechanism. When the radial extension member is capable of releasably attaching to the elongated shuttle valve, the shuttle valve desirably includes at least one retaining member capable of preventing the shuttle valve from being removed from the reservoir opening when the pump cylinder is unlocked.

The invention will be described in greater detail below through embodiments illustrated in the figures.

DETAILED DESCRIPTION

Figure 1:
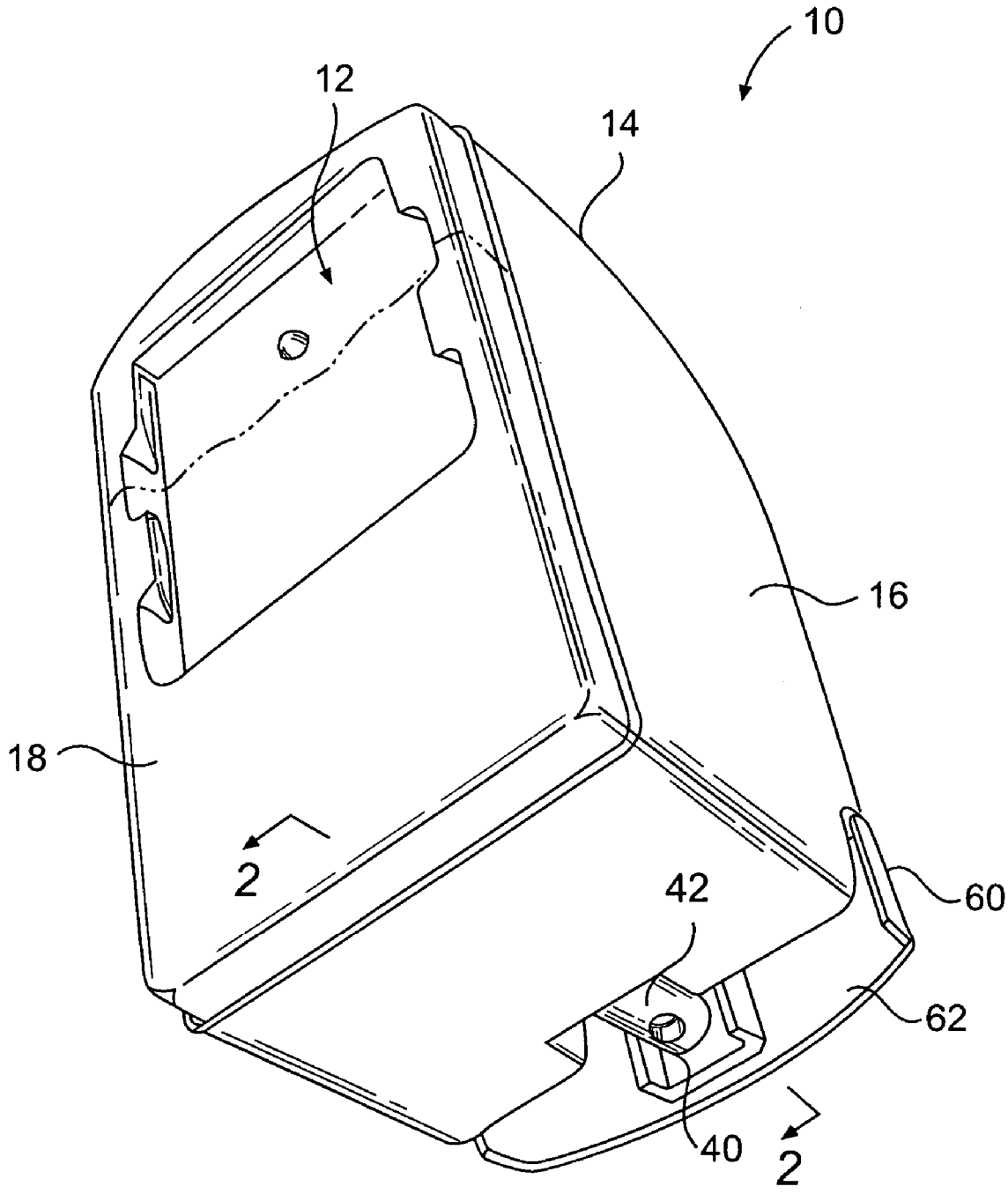
FIG. 1 is a prospective view of a viscous liquid dispenser according to the invention.

Reference will now be made in detail to embodiments of the invention, one or more examples of which are provided in the drawings. Each example is provided by way of explanation of the invention and not meant as a limitation of the invention. For example, features illustrated or described as part of one embodiment may be utilized with another embodiment to yield still a further embodiment. It is intended that the present invention include such modifications and variations as come within the scope of the appended claims and their equivalents.

The present invention relates to a unique dosing pump having a leak protection device for use with any manner of liquid dispenser. The pump apparatus is particularly well suited for use with any manner of viscous liquid dispenser, for example soap dispensers, lotion dispenser, and the like. The present invention also encompasses a dispenser utilizing the unique pump according to the invention. Examples of dispensers that may benefit from the pump and leak protection device of the present invention are described in U.S. Pat. Nos. 6,516,976 to Lewis et al., U.S. Pat. No. 6,533,145 to Lewis et al., U.S. Pat. No. 6,543,651 to Lewis et al., U.S. Pat. No. 6,575,334 to Lewis et al., and U.S. Pat. No. 6,575,335 to Lewis et al., the entireties of which are hereby incorporated by reference.

FIG. 1 illustrates a viscous liquid dispenser 10 that is particularly suited as a liquid soap dispenser. The dispenser 10 comprises a housing, generally 14. The housing 14 may comprise any number of components. For example, the housing 14 may include a front housing member 16 that is connected to a back housing member 18. The dispenser 10 illustrated in FIG. 1 is configured as a disposable liquid soap dispenser that can be removably attached to a wall mounted bracket or the like. For this purpose, mounting structure, generally 12, is integrally formed on the back side 18 of the housing 14.

Figure 2:
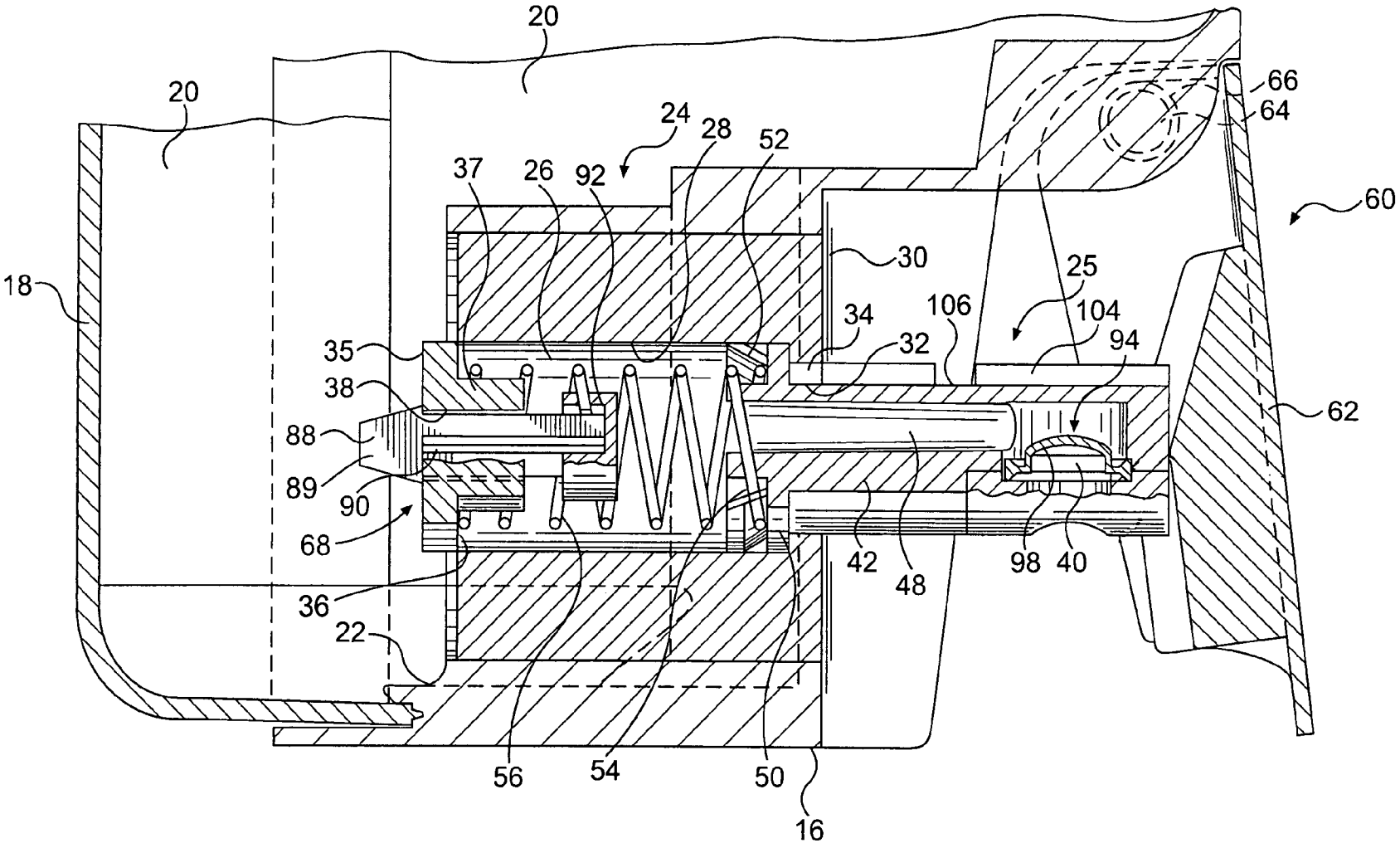
FIG. 2 is a cross sectional view of the pump mechanism taken along the lines indicated in FIG. 1.

The dispenser 10 includes a liquid reservoir, generally 20 (FIG. 2). A dosing pump is configured with the dispenser to dispense metered doses of the viscous liquid contained within the reservoir 20 upon a user depressing or manipulating a pump actuator. The pump actuator may be any structural member that is configured with or connected to a pump mechanism to dispense the viscous liquid from the dispenser 10. The pump mechanism will be described in greater detail below. In the illustrated embodiments, the pump actuator, generally 60, is illustrated as a panel member 62. The panel member 62 adds to the aesthetically pleasing overall configuration of the dispenser 10 and may take on any shape. The panel member 62 illustrated in FIGS. 1 and 2 is pivotally attached to the front component 16 of the housing 14 by way of protrusions 64 that reside in recesses 66 defined in the front component 16. In an alternate embodiment, the actuator 60 may comprise a panel member 62 that is attached directly to the front of the pump mechanism. In this regard, the actuator 60 may comprise any type of plate, button, cap, or like structure that is directly fixed to the pump mechanism. The actuator 60 need not be connected to the housing 14.

The dosing pump apparatus 24 includes a channel 28 defining a pump chamber 26 defined by any manner of structural components. For example, the pump chamber 26 may be defined by wall members that are molded or otherwise formed on an internal surface, i.e., the bottom surface 22 of the housing 14. In this embodiment, the pump chamber 26 is thus disposed completely within the housing 14. In alternate embodiments, the pump chamber may be defined by structural wall members that are attached to the outside surface of the housing member by any conventional means. In either case, the pump chamber 26 is in liquid communication with the reservoir 20. For example, the pump chamber 26 may include a back wall 36 having an opening 38 defined therethrough placing the pump chamber 26 in liquid communication with the reservoir 20. In the embodiment of FIG. 2, the back wall of the pump chamber 26 is defined by an end cap member 35 having the opening 38 defined therethrough. This configuration may be used when it is necessary to insert the pump mechanism into the pump chamber 26 prior to sealing the chamber 26.

The pump chamber 26 has an internal volume that essentially defines the metered amount or dose of liquid to be dispensed therefrom. In this regard, the pump chamber can be configured with any desired volume depending on the intended use of the dispenser 10.

A dispensing orifice 40 is also provided in the pump chamber 26 and defines the exit path for the viscous liquid from the pump chamber 26. In the embodiment illustrated in FIG. 2, the dispensing orifice 40 is defined in a member of the pump mechanism, particularly a cylinder 42 that extends through an opening 32 in a front wall 30 of the pump chamber 26. The pump mechanism of FIG. 2 will be described in greater detail below.

As mentioned, the pump apparatus 24 includes a pump mechanism 25 that is operably configured with the pump chamber 26 to pressurize the viscous liquid contained within the pump chamber upon a user actuating the pump mechanism. Various configurations of devices may be utilized in this regard. For example, the pump mechanism 25 may be a cylinder member 42 that is slidable within the pump chamber 26, as illustrated in FIG. 2. The cylinder 42 extends through an opening in the front wall 30 of the pump chamber and is prevented from being pulled out of the chamber 26 by a flange or piston member 50. The piston member 50 also sealingly engages against the walls of the pump chamber 26. An O ring, may be provided on the piston member 50 for this purpose. The cylinder 42 has a longitudinal dispensing channel 48 defined therethrough. The channel 48 terminates at the dispensing end of the cylinder 42 at the dispensing orifice 40. Thus, in this embodiment, the dispensing orifice 40 is actually defined in the moveable pump cylinder 42.

The cylinder 42 is moveable from a rest position to a pressurized or dispensing position. The cylinder 42 is biased to its rest position by any conventional device, for example a spring 56 disposed within the pump chamber 26. The spring 56 has a forward end fitted in a recess 54 defined by a conical flange member 52. The rear end of the spring 56 is fitted around a cylindrical extension 37 of the end cap member 35. Referring to FIG. 2, the actuator 60 configured as a panel member 62 is disposed in contact against the forward end of the cylinder 42 so that upon a user depressing the panel member 62 from the front side of the dispenser 10, the cylinder 42 is caused to move rearward within the pump chamber 26.

As the cylinder 42 moves into the pump chamber 26, a check valve mechanism (described in greater detail below) seals the opening 38 in the rear wall 36 of the pump chamber in response to an increase in liquid pressure within the chamber. As the pressure of the liquid increases within the chamber, the liquid is eventually dispensed out of the dispensing orifice 40. In the embodiment of FIG. 2, the liquid is caused to travel through the longitudinal channel 48 to be dispensed out of the dispensing end of the cylinder 42.

Upon release of the actuator 60, the cylinder 42 is caused to return to its rest position. As the cylinder moves to the right, a vacuum is drawn within the pump chamber 26 that causes the check valve mechanism to unseat. Liquid from the reservoir 20 is then free to flow into the pump chamber 26 to be dispensed upon the next subsequent actuation of the pump mechanism.

As mentioned, a check valve mechanism, generally 68, is operably disposed in the opening 38 between the pump chamber 26 and the reservoir 20 to seal the opening upon actuation of the pump mechanism 25. Referring to FIGS. 2–6*b*, the check valve mechanism 68 comprises an elongated shuttle valve 88. The shuttle valve 88 is slidable within the opening 38 in the end cap member 35 and has a plurality of radially extending arms 90. Liquid from the reservoir 20 is free to flow past the arms 90 and into the pump chamber 26 so long as the shuttle valve 88 is not sealed against the opening 38. In that regard, the shuttle valve 88 includes a cap 92 that sealingly engages against the end cap member 35 upon actuation of the pump mechanism 25. The cap 92 prevents the liquid contained within the reservoir 20 from escaping through the opening in the chamber 26 and back into the reservoir 20 upon actuation of the pump mechanism 25. Upon release of the pump mechanism 25, the shuttle valve 88 moves into the chamber 26 and thus unseals the opening 38. The static head pressure of the liquid within the reservoir 20 should be sufficient to cause the shuttle valve 88 to unseat and move into the pump chamber 26 to allow the chamber 26 to refill with liquid from the reservoir 20. Unseating of the shuttle valve 88 will be further aided by the vacuum drawn in the chamber 26 upon return of the cylinder 42 to its rest position.

The pump apparatus also includes a restriction device, generally 94, operably disposed across the dispensing orifice 40. The restriction device 94 may include at least one resilient flap member 98, and desirably a plurality of flap members 98 defined by slits (not shown). The resilient flaps 94 have a concave configuration, and the restriction device 94 is disposed within the dispensing orifice so that the concave flaps are oriented upwards or towards the pump chamber 26. Upon sufficient pressure within the pump chamber 26, the liquid causes the resilient flaps 98 to buckle towards the dispensing orifice 40, and the liquid flows through the dispensing orifice 40. Upon release of the pump mechanism 25 and return of the mechanism to its rest position, the resilient flaps move back into engagement against themselves. However, due to the vacuum drawn in the pump chamber as the pump mechanism returns to its rest position, the flaps are pulled slightly apart and towards the pump chamber 26. The flaps move apart just enough so that the pump chamber is vented as the pump mechanism 25 returns to its rest position. Once the pump mechanism has returned to its rest position, the flaps 98 again completely seal against each other and prevent leakage or drippage of liquid from the pump chamber.

The restriction device 94 provides a relatively simple means of preventing leakage from the pump chamber, particularly in embodiments of the invention wherein the pump chamber is horizontally disposed at the bottom portion of the pump reservoir where static pressure of the liquid within the reservoir is greatest. The restriction device 94 also provides a relatively simple means for venting the pump chamber 26 and eliminates the need to vent the pump mechanism around the pump shaft or cylinder which may result in leakage problems. Additionally, the pump mechanism may be incorporated with unvented dispensers since a vent path is defined through the pump mechanism.

Figure 3A:
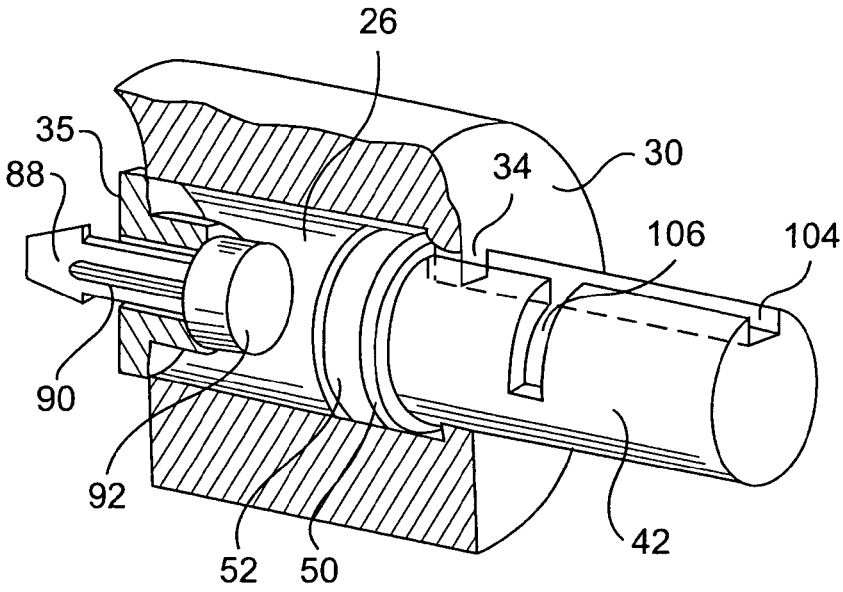
FIG. 3*a* is a partial perspective and cross sectional view of an embodiment of the pump mechanism.
Figure 3B:
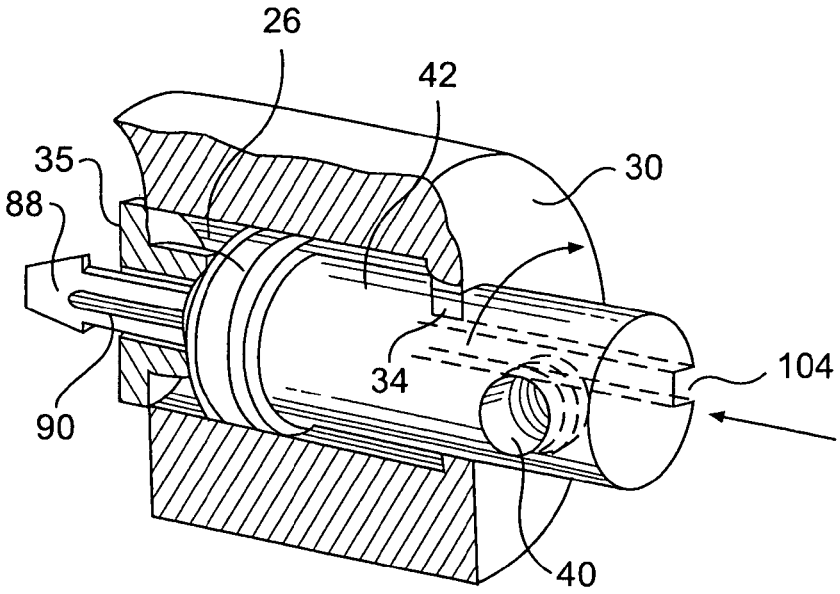
FIG. 3*b* is a partial perspective and cross sectional view of the pump mechanism shown in FIG. 3*a* particularly illustrating a locking feature thereof.
Figure 4:
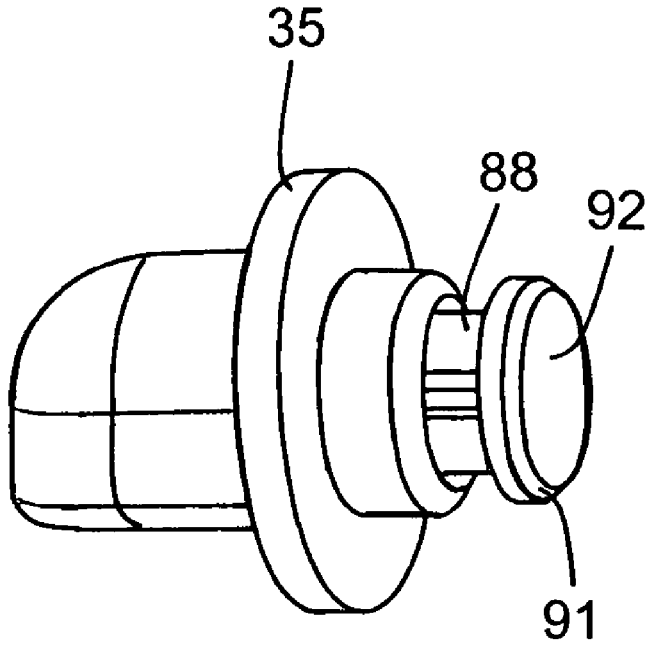
FIG. 4 is a prospective view of a check valve according to the invention.

FIGS. 3*a* and 3*b* illustrate a locking feature of the cylinder 42. A longitudinal channel 104 is defined in the top surface of the cylinder 42 and is engaged by a tab 34 of the front wall 30. The cylinder 42 thus slides along the tab 34 upon depression of the actuator and is prevented from rotating in use. The orientation of the dispensing orifice 40 is thus ensured. A partial circumferential groove 106 is also defined in the surface of the cylinder 42. The groove 106 is located at a position that corresponds essentially to the fully depressed position of the cylinder 42. Referring to FIGS. 3*a* and 3*b*, once the cylinder 42 has been fully depressed, the cylinder 42 may be rotated and engaged by the tab 34. The cylinder 42 is then locked into position. This locking feature is particularly useful during shipment of the dispenser.

Figure 5:
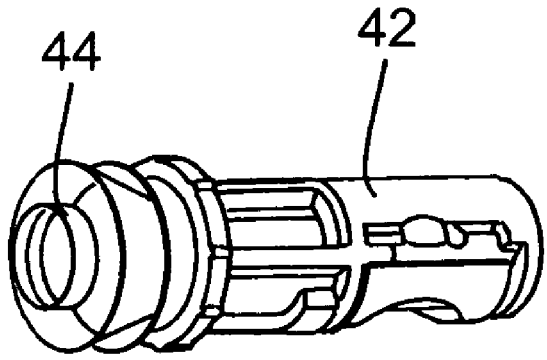
FIG. 5 is a prospective view of a pump cylinder according to the invention.
Figure 6A:
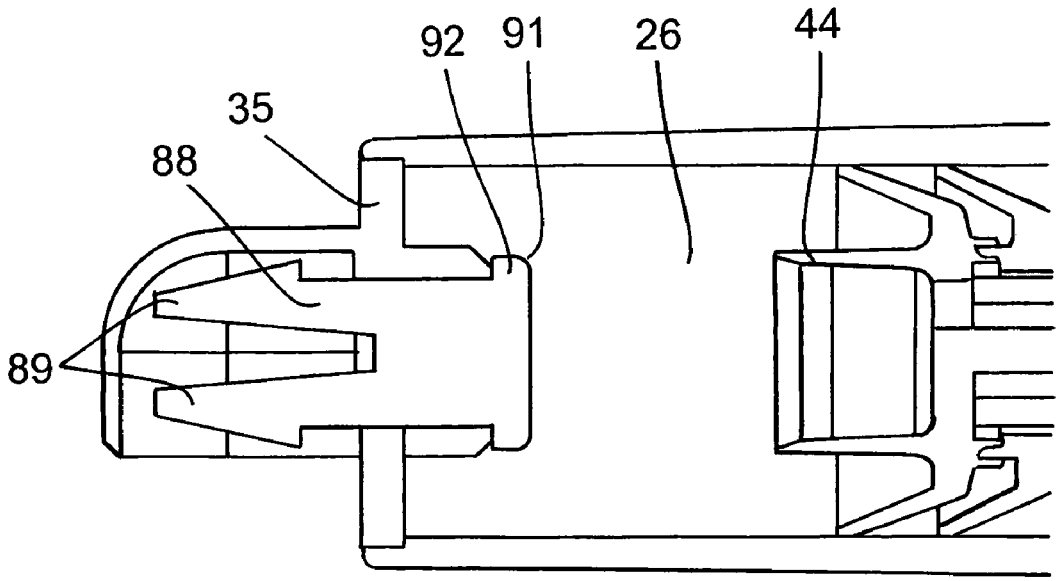
FIG. 6*a* is a cross sectional operational view of the leak protection device.
Figure 6B:
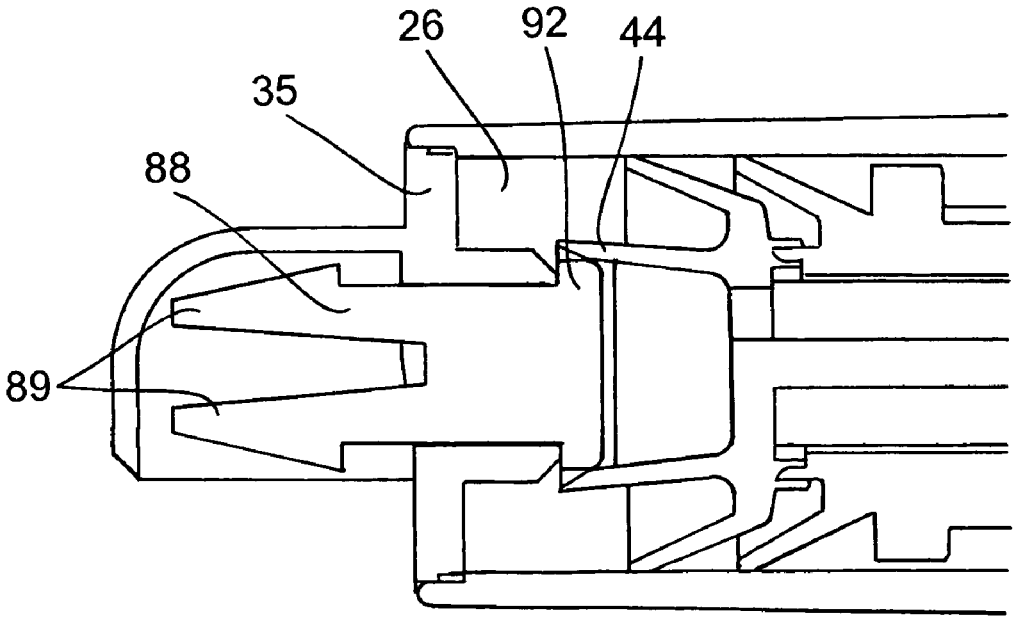
FIG. 6*b* is a cross sectional operational view of the leak protection device.

As shown in FIG. 5, the cylinder 42 is configured with a radial extension member 44 that extends the length of the dispensing channel 48. The radial extension member 44 acts as an inlet axially aligned with the dispensing channel 48. Additionally, referring now to FIGS. 6*a* and 6*b*, the radial extension member 44 sealingly engages the cap 92 of the shuttle valve 88 to prevent the flow of liquid when the pump mechanism 25 is fully depressed to the locking position. The engagement of the shuttle valve 88 with the radial extension member 44 provides two seals against the flow of liquid through the pump chamber 26. First, the radial extension member 44 actively forces the check valve to seal against the opening 38 in the end cap member 35. This first seal isolates the liquid in the reservoir 20 by preventing the flow of liquid from the reservoir into the pump chamber 26. Second, the cap 92 of the shuttle valve 88 forms a second seal against the entrance to the dispensing channel 48. The second seal isolates the liquid in the pump chamber 26 by preventing the flow of liquid from the pump chamber to the dispensing channel 48.

Desirably, the radial extension member 44 is formed from a flexible and/or resilient material. The radial extension member 44 may be tapered to have a larger diameter at the entrance to the dispensing channel so that at its largest diameter, the radial extension member may be larger than the diameter of the cap 92 on the shuttle valve 88. The cap 92 may include a radial beveled, angled, or rounded surface 91 to facilitate engagement of the cap 92 with the radial extension member 44. Optionally, the radial extension member 44 is capable of releasably attaching to the cap 92 of the shuttle valve 88 to form the second seal. Therefore, even if there is some slight movement capable from the pump mechanism 25 when in the locked position, the seal will remain in place between the shuttle valve 88 and the pump channel 48 to prevent leakage. Desirably, when the radial extension member 44 is capable of releasably attaching to the shuttle valve 88, the shuttle valve has at least one retaining member 89 that prevents the shuttle valve from being removed entirely from the opening 38. Therefore, when the pump mechanism 25 is unlocked, the retaining member 89 will restrain the shuttle valve 88 and will enable the separation of the shuttle valve from the radial extension member 44.

It should be appreciated by those skilled in the art that various modification or variations can be made in the invention without departing from the scope and spirit of the invention. It is intended that the invention include such modifications and variations as come within the scope of the appended claims and their equivalents.

What is claimed is:

1. A dispenser for dispensing metered amounts of a viscous liquid, comprising:

a liquid reservoir;

a pump chamber having a reservoir opening in communication with the reservoir;

a pump mechanism configured with the pump chamber, the pump mechanism comprising a pump cylinder slidably disposed and retained in the pump chamber, the pump cylinder comprising a delivery end extending through a front wall of the pump chamber and having a dispensing channel disposed therethrough, the pump cylinder further comprising a radial extension member axially aligned with and extending the length of the dispensing channel, wherein the pump cylinder is movable from a rest position to pressurize liquid within the pump chamber;

a dispensing orifice disposed at a forward end of the dispensing channel; and an elongated shuttle valve operably disposed and retained in the reservoir opening, upon actuation of the pump mechanism the shuttle valve being movable to seal the reservoir opening and upon release of the pump mechanism the shuttle valve being movable to unseal the reservoir opening wherein a metered amount of viscous liquid flows automatically from the reservoir into the pump chamber for dispensing upon the next subsequent actuation of the pump mechanism;

wherein the radial extension member is capable of engaging and releasably attaching to the elongated shuttle valve; and wherein the pump cylinder is movable to a locking position; and further wherein upon movement of the pump cylinder to the locking position the radial extension member engages the shuttle valve, seals the shuttle valve against the reservoir opening to prevent flow from the reservoir to the pump chamber, and seals the dispensing channel against the shuttle valve to prevent flow from the pump chamber to the dispensing channel.

2. The dispenser as in claim 1, wherein the shuttle valve comprises at least one retaining member capable of preventing the shuttle valve from being removed from the reservoir opening.

3. The dispenser as in claim 1, wherein the radial extension member is tapered to permit the radial extension member to fit over and seal against the shuttle valve.

4. The dispenser as in claim 1, wherein the elongated shuttle valve comprises a cap having a radial beveled surface to facilitate sealing engagement of the cap with the radial extension member.

* * * * *